US005505187A

United States Patent [19]

Troncoso et al.

[11] Patent Number: 5,505,187

[45] Date of Patent: Apr. 9, 1996

[54] ARCHERY BOWSTRING RELEASE DEVICE AND TRIGGER ASSEMBLY FOR THE SAME

[75] Inventors: Vincent Troncoso; Stephen Johnson, both of Montrose, Colo.

[73] Assignee: Golden Key Futura, Inc., Montrose, Colo.

[21] Appl. No.: 291,520

[22] Filed: Aug. 15, 1994

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 2,819,707 | 1/1958 | Kayfes et al. | 124/35.2 |
| 5,070,854 | 12/1991 | Peck | 124/35.2 |
| 5,078,116 | 1/1992 | Peck | 124/35.2 |
| 5,307,788 | 5/1994 | Peck | 124/35.2 |
| 5,370,102 | 12/1994 | Peck | 124/35.2 |

OTHER PUBLICATIONS

Advertisement for "Cantpunch" release, Archery Magazine, Nov. 1978, p. 24.

*Primary Examiner*—Eric K. Nicholson

*Assistant Examiner*—John A. Ricci

*Attorney, Agent, or Firm*—Donald E. Nist

[57] ABSTRACT

The archery bowstring release device includes a hollow housing having a front end and opposite rear end. A pair of openable bowstring-engaging jaws is hinged to the front end of the housing. A trigger projects from the side of the housing and is moveable between a relaxed forward non-firing position and a rearward firing position against the biasing action of a spring. An elongated drive bar is connected to the trigger and intercepts the jaws to hold them closed when the trigger is in the non-firing position. A propelor bar is hinged for longitudinal rotation in a slot in the drive bar and extends rearwardly thereof. A spring in the housing bears against the rear portion of the propellor bar when the trigger is in the forward position and against the front portion of the propellor bar when the trigger is in the firing position. A moveable detent intercepts the propellor bar, preventing firing, if the trigger is moved rapidly rearwardly. If the trigger is moved slowly rearwardly the spring has sufficient time to rotate the propellor bar out of the way of the detent, permitting firing of the device, thus assuring smooth proper firing.

9 Claims, 2 Drawing Sheets

ARCHERY BOWSTRING RELEASE DEVICE AND TRIGGER ASSEMBLY FOR THE SAME

BACKGROUND OF THE INVENTION

1. Field of the Invention

The present invention generally relates to archery and more particularly to an improved archery bowstring release device and trigger assembly for the same.

2. Prior Art

Many types of archery bowstring release devices have been devised for use in place of the fingers or a tab operated by the fingers in shooting arrows from an archery bow. Certain of the older release devices comprise simple metallic hooks. Certain other of such devices employ strings or ropes releasably secured to trigger posts or the like. Newer release devices generally are more complicated and include various moving parts, including triggers which must be pulled a considerable distance in order to cause the device to disengage from an archery bowstring and thus fire an arrow from the bow.

Many archers tend to anticipate the release of the device and the arrow. In so doing, they flinch or jerk the device, causing shooting inaccuracies. This is a serious problem when the archery bow is used in competition where precision shooting is the object. This is also a problem when the archery bow is used for hunting purposes, since it may result in missing the target. Archery hunting is inherently difficult, because the hunter must stealthily approach the game and be fairly close to it in order to assure a clean kill. Jerking the bowstring upon release of the arrow wastes time, tries patience and may result either in a miss or in merely wounding the game, requiring the hunter to then spend much time tracking the game in order to finally kill it.

Flinching while shooting an archery bow is analogous to jerking the trigger of a gun or tightening up and missing a putt during golf. Teaching an archer how to make a smooth, steady slow release without flinching is difficult. Accordingly, there is a need for a simple archery bowstring release device which trains the archer not to flinch and which assures that each arrow when shot will be shot without flinching. Such device should be inexpensive, durable, simple to use and adjust and be capable of providing superior shooting accuracy.

SUMMARY OF THE INVENTION

The improved archery bowstring release device of the present invention and the improved trigger assembly incorporated in the same satisfy all the foregoing needs. The device and the trigger assembly are substantially as set forth in the ABSTRACT OF THE DISCLOSURE.

Thus, the device includes a hollow housing, preferably elongated and containing a longitudinal central passageway therein. The front end of the housing is connected to a pair of hinged openable bowstring-engaging jaws. A trigger extends from the housing, preferably from one side thereof, and is moveable from a relaxed forward non-firing position to a rearward firing position against the biasing action of an internal spring in the housing.

An elongated drive bar is disposed in the housing and is connected to the trigger, which moves the bar forwardly and rearwardly. The front end of the drive bar is received within a space between the jaws when the trigger is in the non-firing position, preventing the jaws from opening and is retracted therefrom by the trigger when the trigger is moved to the firing position, permitting the bowstring to open the jaws and fire the arrow from the bowstring.

The rear end of the drive bar has a longitudinal slot therein with a propellor bar secured therein for rotation along the longitudinal axis of the drive bar. The rear portion of the propellor bar extends rearwardly of the drive bar. A spring secured in the housing, preferably rearwardly of the propellor bar, is arcuate-shaped and bears against the rear portion of the propellor bar when the propellor bar is in the forward non-firing position, and forcing the front portion of the propellor bar to pivot into the drive bar, moving the rear portion of the propellor bar out of the path of an adjustable detent when the drive bar and propellor bar are slowly moved rearwardly into the trigger firing position.

If the trigger is rapidly moved or jerked rearwardly in order to fire the device, the rear end of the propellor bar runs into the detent and prevents opening of the front jaws so that the device cannot be fired. This occurs because the propellor bar does not have time to pivot out of the path of the detent before running into it, due to frictional drag of the spring on it.

Thus, an effective means is built into the improved release device to prevent improper,hasty, jerky pulling of the trigger which would result in inaccurate firing of the device. It will be understood that the device is therefore a highly effective training device to teach an archer to move the trigger rearwardly slowly and smoothly in order to fire the device.

The detent is preferably accessible through a portion of the housing, such as the side thereof, in order to adjust the length of extension of the detent into the path of the propellor bar. If desired, the detent can be fully retracted out of the path of the propellor bar once the archer has learned from the device how to slowly and smoothly move the trigger into the firing position.

Further features of the present invention are set forth in the following detailed description and accompanying drawings.

DRAWINGS

Figure 1:
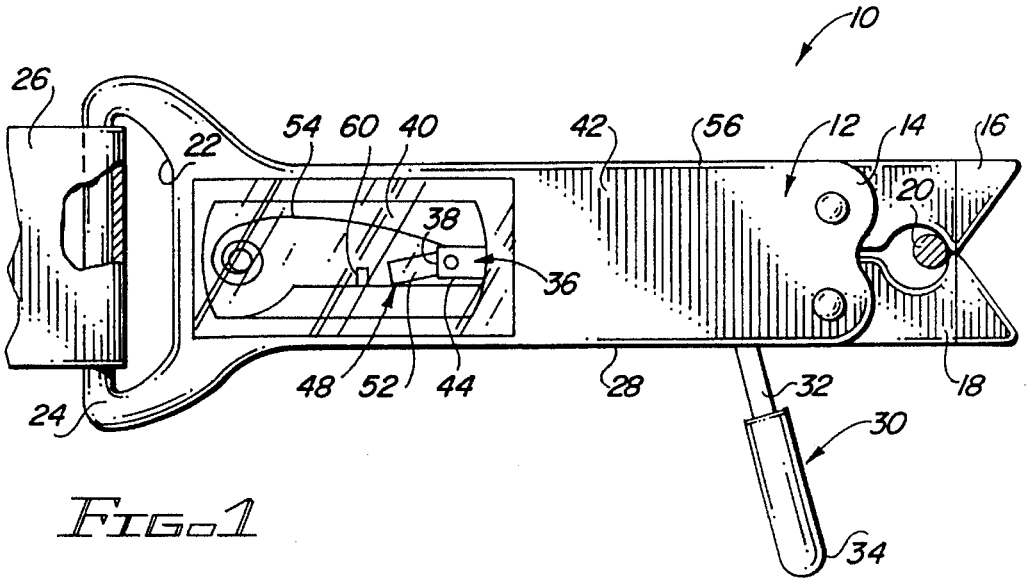
FIG. 1 is a schematic top plan view, partly broken away, of a preferred embodiment of the improved archery bowstring release device of the present invention, shown with the jaws of the device closed around a bowstring and with the trigger thereof in the forward relaxed position.
Figure 2:
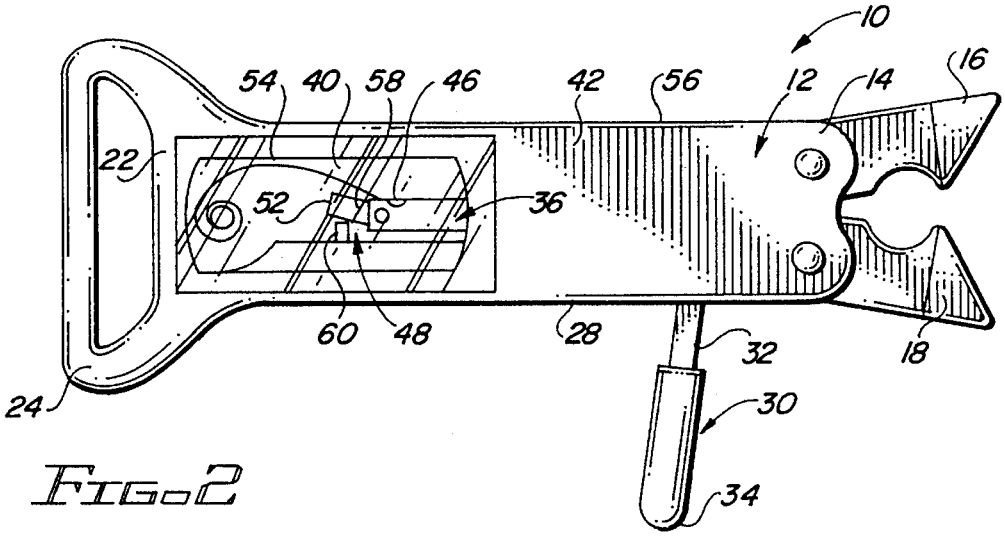
FIG. 2 is a schematic top plan view, partly broken away, of the device of FIG. 1, minus the wrist strap and showing the device immediately after firing, the bowstring having been released from the now open jaws and the trigger being in the far rearward fired position.
Figure 3:
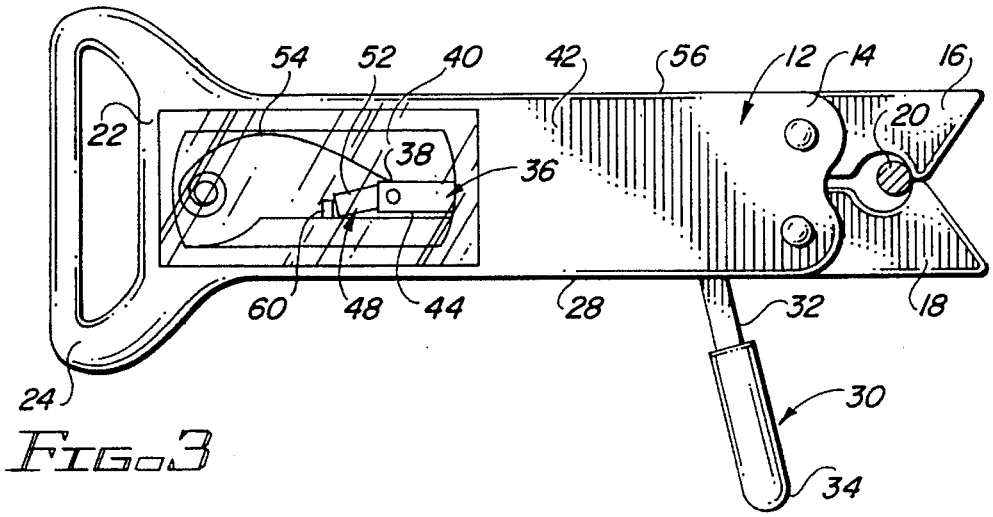
Figure 4:
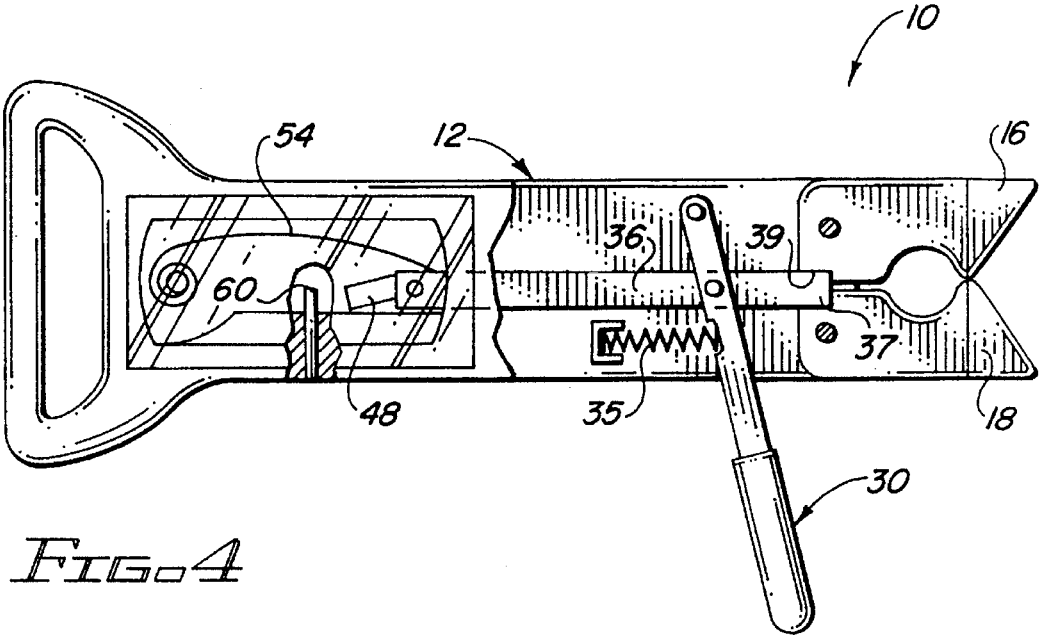
Figure 5:
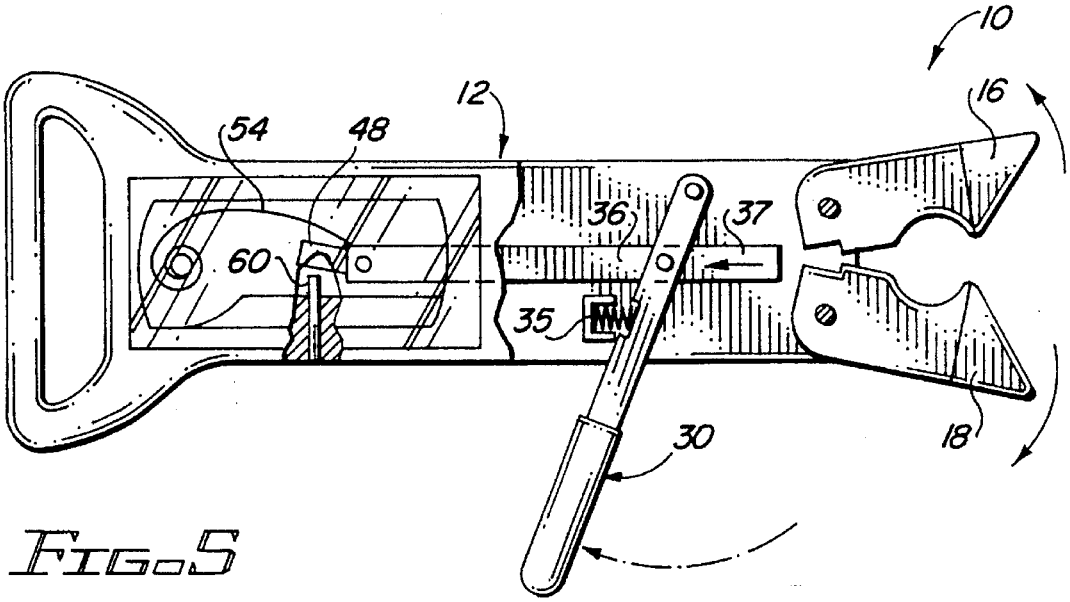

FIG. 3 is a schematic top plan view, partly broken away, of the device of FIG. 1, minus the wrist strap and showing the device with the propellor bar thereof blocked against the detent thereof, preventing the firing of the device, that is, preventing opening of the jaws and release of the bowstring therefrom, said blocking against firing being due to too rapid and/or jerky pulling of the trigger back toward the firing position shown in FIG. 2;

FIG. 4 is a schematic top plan view of the device of FIG. 1, the housing thereof being partly broken away to illustrate the linkage between the front jaws, the trigger and the drive bar of the device; and, FIG. 5 is a schematic top plan view of the device of FIG. 1, the housing thereof being partly broken away to illustrate the position of the internal components thereof when the trigger is in the firing position.

DETAILED DESCRIPTION

FIGS. 1–5.

Now referring to FIGS. 1–5 of the drawings, a preferred embodiment of the improved archery bowstring release device of the present invention and the improved trigger assembly thereof is set forth therein.

Thus, device 10 is shown, which comprises a hollow housing 12, to the front end 14 of which is secured an archery bowstring retaining means in the form of a spaced pair of openable jaws 16 and 18 hinged to said front end 14 for movement between the closed position shown in FIGS. 1, 3 and 4 and the open position shown in FIGS. 2 and 3. In FIGS. 1 and 3 jaws 16 and 18 are shown releasably retaining an archery bowstring 20 so that the archer can draw back the bowstring from the limbs of an archery bow ( not shown) to which the ends of bowstring 20 are attached.

The rear end 22 of housing 12 is configured to form a closed loop 24 through which a leather hand, wrist or arm grip 26 or the like is secured to facilitate drawing bowstring 20 back from the archery bow by means of device 10. If desired, grip 26 can be dispensed with and housing rear end 22 can merely be gripped with the fingers of the archer for the described drawing back of the bowstring 20.

Projecting outwardly from one side 28 of housing 12 is a trigger 30 in the form of an elongated arm 32 pivotally secured in housing 12 for longitudinal rotation of free end 34 thereof and biased to its forward position, as by a spring 35 ( FIGS. 4 and 5). Trigger arm 32 is also pivotally secured in housing 12 to a longitudinally extending drive bar 36, the rear end 38 of which can be seen in FIGS. 1–5 through a transparent window 40 in the top 42 of housing 12.

The front portion 37 of drive bar 36 is received within a space 39 between jaws 16 and 18 preventing them from opening when trigger 30 is in the forward non-firing position of FIGS. 1 and 4. However, when trigger 30 is pulled back to the firing position of FIGS. 2 and 5 drive bar 36 is retracted by trigger 30 from space 39, allowing bowstring 20 to force jaws 16 and 18 to fully open, permitting release of bowstring 20 therefrom and firing of an arrow therefrom.

After said firing, jaws 16 and 18 can be manually closed around bowstring 20, or bowstring 20 can be forced back into the throat between jaws 16 and 18 to cause them to close around it, so that the archer is then ready to make the next shot. Spring 35 automatically moves trigger 30 into the forward non-firing position of FIG. 1 and front end 37 of drive bar 36 prevents jaws 16 and 18 from opening until the previously described firing sequence is carried out.

The rear end 38 of drive bar 36 is, as is the remainder of drive bar 36, disposed in an elongated channel 44 at about the longitudinal axis in housing 12. Rear end 38 has a central longitudinally extending slot 46 therein in which is pivotally connected a propellor bar 48, the front half 50 of which lies in slot 46 and the rear half 52 of which extends rearwardly of bar 36. Propellor bar 48 rotates along the longitudinal axis of bar 36. An elongated arcuate spring 54 is secured in housing 12 behind propellor bar 48 and extends forwardly to abut one side 56 of propellor bar 48. When propellor bar 48 is in the trigger forward position of FIG. 1, rear half 52 of propellor bar 48 is pressed by spring 54 toward the side 28 of housing 12, whereas when propellor bar 48 is in the trigger firing position of FIG. 3, spring 54 now contacts front half 50 , pressing it into slot 46 and rotating rear half 52 of propellor bar 48 toward side 58 of housing 12, said side being opposite side 28 of housing 12.

An adjustable detent 60 projects inwardly from side 28 of housing and into the path of travel of propellor bar 48. Detent 60 preferably is threaded into an opening (not shown) in side 28 so its extent of projection ( if any) into said path can be regulated as desired by screwing it in or out.

As can be seen in FIG. 3, when trigger 30 is moved rapidly or jerked suddenly rearwardly, rear half 52 of propellor bar 48 strikes detent 60 so that trigger 30 cannot move into the firing position of FIG. 2 to enable bar 36 to be fully retracted and permit jaws 16 and 18 to open for firing of bowstring 20 therefrom. Thus, this sudden rearward movement of trigger 30 causes rear half 52 of propellor bar 48 to suddenly move rearwardly too fast to enable rear half 52 of propellor bar 48 to swing away from detent 60, upon urging by spring 54, due to friction between spring 54 and bar 48, so as to clear detent 60 rather than being driven against it and freezing trigger 30.

This feature of the improved trigger of the present invention prevents flinching by an archer during shooting which would result in misfiring of the bowstring and arrow, with consequent missing of the target. Instead, the archer learns to smoothly and slowly squeeze trigger 30 rearwardly for an optimal release of bowstring 20 and the arrow ( not shown) attached thereto. Thus, the trigger assembly specified herein and the improved release constitute an improved accuracy training aid and a positive prevention against sloppy and dangerous arrow firings.

It will be understood that release 10 and the components thereof can be made in any suitable size and shape and of any suitable durable materials, including aluminum, brass, stainless steel and the like, as well as ceramics, cements, etc. Various modifications, changes, alterations and additions can be made in the improved release device and trigger assembly of the present invention and in the components and parameters thereof. All such modifications, changes, alterations and additions as are within the scope of the appended claims form part of the present invention.

What is claimed is:

1. An improved anti-punch archery bowstring release device comprising, in combination:

a) a hollow housing having a front end and an opposite rear end;

b) a pair of openable bowstring-engaging jaws hinged to the front end of said housing;

c) a trigger projecting from said housing and moveable between a forward non-firing position and a rearward firing position;

d) means biasing said trigger into said forward position e) an elongated drive bar in said housing, said drive bar having a front end and a rear end, said drive bar being connected to said trigger, said front end of said drive bar being receivable in said jaws to lock said jaws closed when said trigger is in said non-firing position but permitting opening of said jaws by a bowstring when said trigger is in said rearward firing position, said jaws being manually closeable when said trigger is in said non-firing position;

f) a propellor bar rotatably hinged to the rear end of said drive bar along the longitudinal axis of said drive bar, said propellor bar having a front portion within a slot in said drive bar and having a rear portion projecting rearwardly from said rear end of said drive bar;

g) a spring in said housing rearward of said propellor bar and engaging said propellor bar, said spring exerting frictional drag on and rotating said propellor bar during movement of said drive bar by said trigger; and, h) a moveable detent in said housing behind and in the path of said rear portion of said propellor bar, said detent intercepting said propellor bar only when said trigger is sufficiently rapidly jerked backward so that said propellor bar cannot rotate rapidly enough due to said frictional drag to clear said detent, thereby preventing opening of said jaws to release a bowstring releasably held therein, said spring rotating said rear portion of said propellor bar away from said detent when said trigger is moved backward in a slow non-jerking manner, permitting firing of said trigger, said release thereby providing improved shooting capability.

2. The improved release device of claim 1 wherein said trigger extends from one side of said housing, and wherein said detent is threaded into said housing and is adjustable in length.

3. The improved release device of claim 1 wherein said rear end of said device is connected to a strap for holding said device.

4. The improved release device of claim 1 wherein said propellor bar is hinged at about the midpoint thereof to said rear end of said drive bar, and wherein said spring is arcuate and abuts said front portion of said propellor bar said propellor bar is moved rearwardly, causing said propellor bar to rotate away from said detent.

5. The improved release device of claim 1 wherein said drive bar and propellor bar are disposed in a slot in said housing and extend along the length of said housing, wherein said trigger and said detent extend from one side of said housing and wherein said detent is moveable into said housing an adjustable distance.

6. An improved anti-punch trigger assembly for an archery bowstring release device having a hollow housing and openable jaws, said assembly comprising, in combination:

a) a trigger projecting from said housing and moveable between a forward non-firing position and a rearward firing position;

b) means biasing said trigger into said forward position;

c) an elongated drive bar in said housing, said drive bar being connected to said trigger and receivable between said jaws to lock said jaws closed, said drive bar being retracted from said jaws by said trigger to permit opening of said jaws and release of a bowstring therefrom when said trigger is in said rearward firing position;

d) a propellor bar hinged to the rear end of said drive bar for rotation therearound, said propellor bar having a front portion overlapping said drive bar, said propellor bar having a rear portion projecting rearwardly from said rear end of said drive bar;

e) a spring in said housing engaging and exerting frictional drag on said propellor bar, said spring rotating said propellor bar during movement of said drive bar by said trigger; and, f) a moveable detent in said housing behind said propellor bar and intercepting said propellor bar only when said trigger is moved sufficiently rapidly backward so that propellor bar, due to said frictional drag, cannot clear said detent, thereby preventing firing of said trigger, that is, preventing opening of said jaws to release a bowstring therein, said spring rotating said rear end of said propellor bar away from said detent when said trigger is moved slowly backward, thereby permitting firing of said trigger.

7. The improved trigger assembly of claim 6 wherein said trigger extends from one side of said housing and wherein said detent intersects said path of said propellor bar and is rearwardly thereof.

8. The improved trigger assembly of claim 7 wherein said propellor bar is pivotably connected at about the midpoint thereof to said rear end of said drive bar within a slot therein for rotation along the longitudinal midline of said drive bar, wherein said spring is arcuate and abuts said rear portion of said propellor bar when said propellor bar is in a forward position and abuts said front portion of said propellor bar when said propellor bar is in a rearward position so as to rotate said propellor bar away from said detent.

9. The improved trigger assembly of claim 8 wherein said detent is threadably disposed through a side of said housing and is moveable into said housing an adjustable distance.

* * * * *